United States Patent [19]

Hattori et al.

[11] Patent Number: 4,540,965

[45] Date of Patent: Sep. 10, 1985

[54] ELECTROMAGNETIC ASSEMBLY

[75] Inventors: Masaichi Hattori; Shigeo Hara; Shunichi Manabe, all of Aichi, Japan

[73] Assignee: Kabushiki Kaisha Tokai Rika Denki Seisakusho, Aichi, Japan

[21] Appl. No.: 584,763

[22] Filed: Feb. 29, 1984

[30] Foreign Application Priority Data

Mar. 2, 1983 [JP] Japan ..... 58-032904

[51] Int. Cl.[3] ..... H01F 7/08

[52] U.S. Cl. ..... 335/259; 335/265

[58] Field of Search ..... 335/259, 264, 265, 266, 335/267, 274

[56] References Cited

U.S. PATENT DOCUMENTS 2,991,799 7/1961 Littlefield ..... 335/265

3,988,706 10/1976 Springer ..... 335/259

4,327,345 4/1982 Kelso et al. ..... 335/265

*Primary Examiner*—George Harris

*Attorney, Agent, or Firm*—Shlesinger, Arkwright, Garvey & Fado

[57] ABSTRACT

An electromagnet assembly is provided. It has a first movable core and a second movable core provided in association with a coil. The first movable core is energized toward the second movable core by a first spring while the second movable core is urged in the direction away from the first movable core by a second spring which has larger biasing force than that of the first spring. When the second movable core is attracted by magnetic excitation of the coil, the first movable core is pressed downwards by the second movable core.

20 Claims, 25 Drawing Figures

ELECTROMAGNETIC ASSEMBLY

BACKGROUND OF THE INVENTION

This invention relates to an electromagnetic assembly which is used for locking a switch in its operative position for operating, for example, the car window, the sun roof, the automatic antenna and the like, or locking the switch normally in its "on" position and releasing the switch from the lock position in the event of or overvoltage in order to protect the circuitry from being damaged.

Heretofore, the relay for maintaining the energized state of the circuit or of the plunger of a solenoid utilized for performing a required function has been separated from the relay used for detecting overcurrent and overvoltage in order to break the circuit.

For example, when the car power window is to be opened or closed by one-touch operation or by instant switch-on operation, the following devices were required: (1) relay for detecting the state of "switch-on" in order to continue supplying power to a motor and (2) an electronic circuit, a relay, etc. for detecting overcurrent due to motor-lock when the motor is locked and removing the self-holding state maintained by above mentioned relay when the window completes the opening or closing operation.

Therefore, high costs, complicated structure of circuitry, etc, to large installation space, use of the additional electronic circuit, the relay and the like resulted in inherent disadvantages to the prior art devices.

SUMMARY OF THE INVENTION

It is therefore an object of the present invention to overcome the above mentioned disadvantages of the prior art and to provide an assembly having the two functions of self-holding the switch and of removing the self-holding through activation of two movable members utilizing the amount of electric current in one coil so that smaller installation space and simplified structure of the circuit can be attained.

It is another object of the present invention to provide an electromagnet assembly in which the "switch-on" state is held by a first movable member and the removal thereof is done by a second movable member, thus enabling one-touch operation of the car power window, the sun roof, the automatic antenna and the like.

To achieve the above mentioned objects, there is essentially provided an electromagnet assembly comprising a coil adapted to be energized and deenergized in accordance with external switching operation; first and second magnetic members positioned in a magnetic circuit energized by energization of said coil and being movable within respective limited ranges; first resilient means adapted to press said first magnetic member against said second magnetic member; and second resilient means adapted to urge said second magnetic means in a direction away from said first magnetic means, said second resilient means having a stronger force than said first resilient means, said first magnetic member being adapted to be urged toward said second magnetic member by energization of said coil when a prescribed current flows therethrough, said second magnetic member being adapted to be urged toward said first magnetic member by energization of said coil when a current having a value greater than said prescribed value flows therethrough.

BRIEF DESCRIPTION OF THE DRAWINGS

FIGS. 1 to 3 are sectional views showing one embodiment of the invention, wherein FIG. 1 shows the state when electric current stops flowing, FIG. 2 shows the state when the prescribed current flows, and FIG. 3 shows the state when overcurrent flows;

FIGS. 5 to 16 are views showing various embodiments of switch sections according to the present invention, wherein FIG. 5 is a plan view, FIG. 6 is a side view, FIG. 7 is a sectional view taken along line A—A of FIG. 5, FIG. 8 is a sectional view taken along line B—B of FIG. 5, FIG. 9 is a plan view of the movable contact portion, FIG. 10 is a circuit thereof, FIG. 11 is a front view of a guide plate, FIG. 12 is a front view of a retaining member, FIG. 13 is a sectional view, on an enlarged scale, of a portion taken along line A—A during intermediate operation of a knob, FIG. 14 is an enlarged sectional view taken along line B—B of the above, FIG. 15 is an enlarged sectional view of the knob taken along line A—A, particularly showing the knob when it is operated until lock, and FIG. 16 is a sectional view, on an enlarged scale, of the above taken along line B—B;

DETAILED DESCRIPTION OF THE EMBODIMENTS

A preferred embodiment according to the present invention will be described hereunder with reference to the accompanying drawings.

Figure 1:
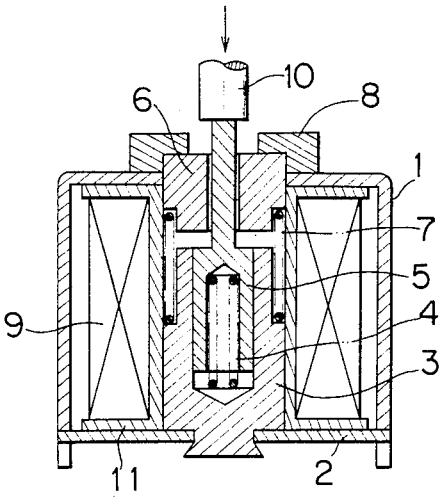
Figure 2:
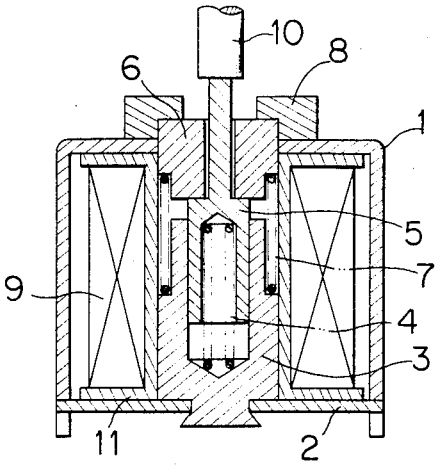
Figure 3:
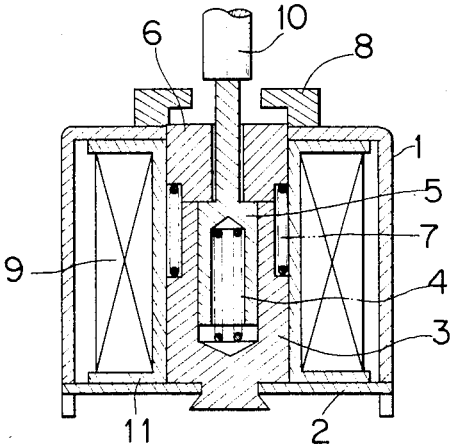

Referring first to FIGS. 1 to 3, a first magnetic member in the form of a first movable core 5 is slidably contained within a bore formed in a stationary core 3 with a spring 4 extending therebetween. Said stationary core 3 is calked into a plate 2 mounted on a yoke 1.

A second magnetic member in the form of a second movable core 6 is slidably contained within said yoke 1 at an opposite position relative to said stationary core 3. Extending between said second movable core 6 and stationary core 3 is a spring 7 which has a larger biasing force than said spring 4. A stopper 8 for preventing said second movable core 6 from escaping therefrom is fixedly secured to said yoke 1. Furthermore, the upper end portion of said first movable member 5 abuts against a switch position retaining member. Retaining member 10 is movable against and in a direction opposite to the biasing force of said spring 4 by application of a force stronger than that of said spring 4 but weaker than the total of the force of said spring 4 and the force with which a coil 9, when it is excited, urges said first movable core 5 toward the second movable core 6. In the drawing, numeral 11 denotes a bobbin around which said coil 9 is wound.

When no current is flowing through said coil 9, said first movable core 5 is held in its depressed position, as shown in FIG. 1, because the urging force of said retaining member 10 is stronger than the force of said spring 4.

Next, when said retaining member 10 is moved upwards to a position higher than the position shown in FIG. 1, said first movable core 5 in turn is moved upwards by means of said spring 4 and abuts said second movable core 6. On the other hand, when a prescribed current flows through said coil 9, upon closing of a contact (not shown), said first movable core 5 is held by the attraction of said second movable core 6 even when the lifting force for said retaining member 10 is removed. In other words, said retaining member 10 is self-retained in the position shown in FIG. 2 by the force of said spring 7 and the attraction between said first and second movable cores 5 and 6.

Then, when overcurrent exceeding the prescribed value flows through said coil 9, the magnetic flux passing through said first movable core 5 and second movable core 6 in FIG. 2 saturates the movable members 5 and 6. If the current flowing through said coil 9 is increased in this situation, the magnetic flux passing through said first movable core 5 will not be increased any more. As a result, an extra flux is created between said movable core 6 and stationary core 3 so that the attractive force between said second movable core 6 and stationary core 3 become larger than the value obtained by subtraction of the load of said retaining member 10 from the sum of the loads of said springs 4 and 7. As a result, said second movable core 6, together with said first movable core 5 attracted thereby, is lowered to a position shown in FIG. 3. Since said retaining member 10 is also lowered and follows said first and second movable cores 5 and 6, a contact (not shown) is opened and the current stops flowing through said coil 9. This causes said second working core 6 to return to its initial position shown in FIG. 1 by means of said spring 7 to the state before operation.

Referring now to FIGS. 5 to 16, description will be made of a switch section which operates in cooperation with the electromagnet assembly of the invention. Said switch section can hold the "ON" state when a prescribed value of current flows through coil 9 and can shift from the "ON" state to the "OFF" state when overcurrent is present.

There is mounted a casing 13 on top of said yoke 1. A knob 14 is pivotably supported on said casing and therewithin on shaft 12. Said knob 14 has a horizontally extending projection **14*a* (See FIG. 5) formed with a top-closed and downwardly opened bore 14*a*' (See FIG. 7). An elongated presser 16 is slidably inserted within said bore 14*a*' and a spring extends between the projection 14*a* and the presser 16. Said casing 13 has a guide section 25 in the form of a vertically extending space. Said guide section 25 is defined by a V-shaped floor and two opposite upright walls. Said V-shaped floor includes a pair of guide slopes 25*a* meeting each other at a neutral point. Said two opposite upright walls are formed with a pair of slits 25' therein. A detent plate 10** is formed with a generally V-shaped notch.

Figure 4:
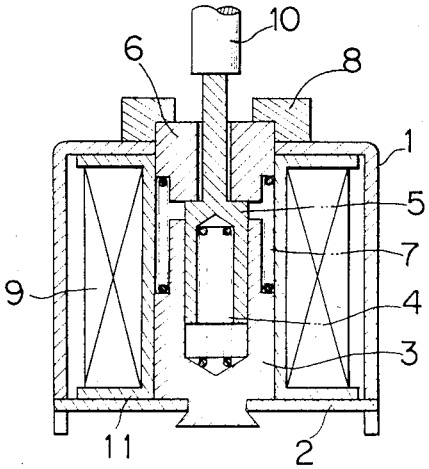
FIG. 4 is a sectional view of a modified form of the embodiment shown in FIG. 1.
Figure 9:
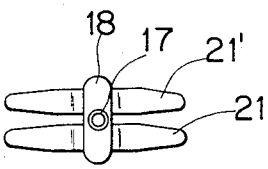
Figure 10:
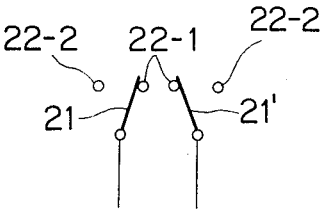
Figure 5:
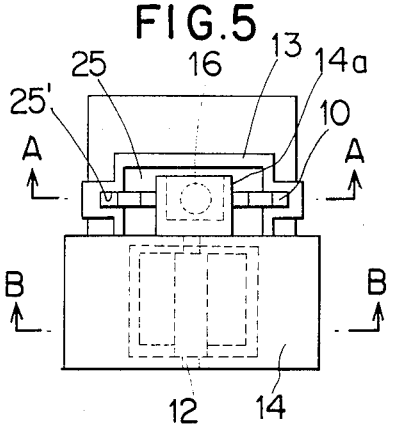
Figure 6:
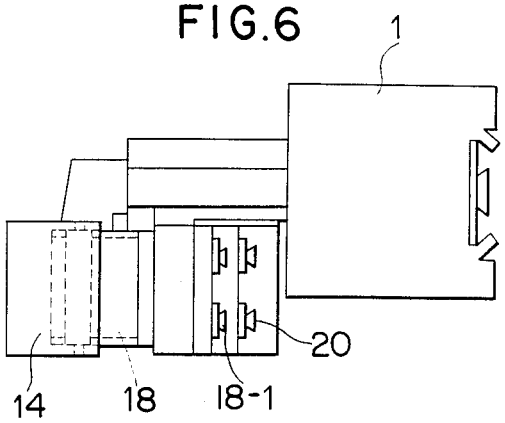
Figure 7:
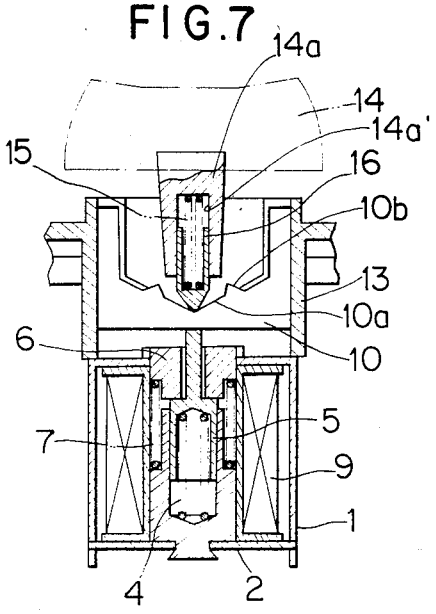
Figure 12:
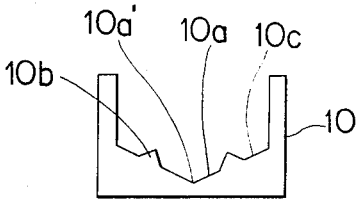
Figure 13:
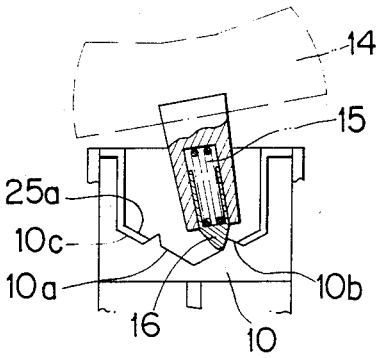
Figure 14:
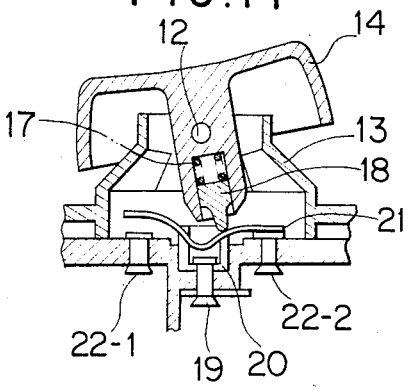
Figure 15:
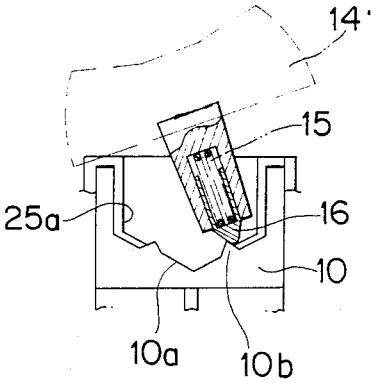
Figure 16:
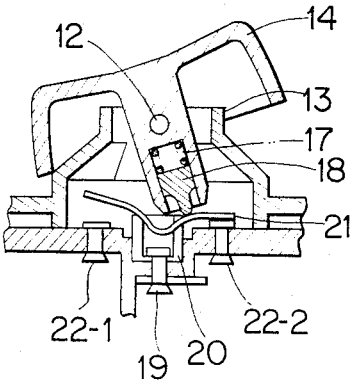

Said V-shaped notch, as best shown in FIG. 12 is defined by a pair of first slopes **10*a* meeting each other at a neutral point 10*a*', a pair of detent projections 10*b* are formed at the top of the respective first slopes, and a pair of second slopes 10*c* are formed above said detent projections 10*b*. Said pair of first slopes 10*a* of the V-shaped notch in the detent plate 10 extend in identical planes with said pair of guide slopes 25*a*. Said elongated presser 16 is positioned such that the lowest tip thereof abuts said first slopes 10*a* and said guide slopes 25*a* simultaneously. The lower end of said detent plate 10 is in contact with the top of the projecting portion of first movable core 5. However, said retaining member 10 may have a projecting portion of its own which extends through the bore of said second movable core 6 to abut said first movable core 6, as shown in FIG. 4. When the lowest tip portion of said presser 16 follows said slopes 10*a* and 25*a* at said neutral points thereof, said first movable core 5 is in the position shown in FIG. 7 because of the biasing force of said spring 4. Even if said knob 14 is manually depressed to take a tilted position as shown in FIG. 13, said presser 16 slides along the slopes 10*a* and 25*a* to the initial position. Furthermore, even if said knob 14 is further tilted to override the projecting detents 10*b* and achieves the position shown in FIG. 15, said knob 14 again returns to said initial position, because said retaining member 10 is pushed downwards by said presser 16 against the biasing force of spring 4. Actually however, when the presser 16 overrides the detent projection 10*b*, the switch section causes sufficient current to flow through the coil 9 to lock the knob 14 in the FIG. 15 position in accordance with a principle which will be described later. This causes a window, for example, to start closing. Since the motor continues to operate even when the window has been closed, overcurrent flows through said coil 9 and attracts said second movable core 6 toward said stationary core 3, thereby pressing said first movable core 5 downwards. The force urging said retaining member 10 upwards is removed and said retaining member 10 is pressed downwards by means of said spring 15. As a result, said presser 16 overrides the detent projection 10*b* and is released from detention thereby and slides along the slope 10*a* of the generally V-shaped notch, to cause said knob 14** to return to its horizontal position.

Figure 8:
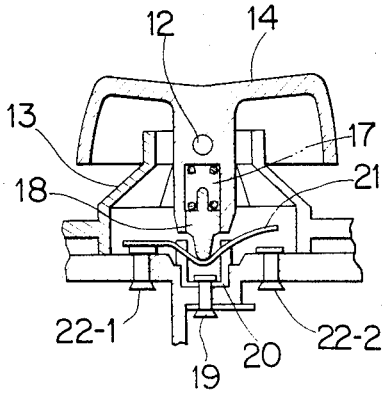
Figure 11:
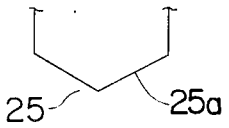

Referring now to FIG. 8, presser 18 is loaded by spring 17 for actuating the switch is contained in said knob 14. Two contacts 21 and 21' are axially supported by a supporting piece 20 which is secured by a common contact 19 and which is pressed at their center. When said knob 14 is in the horizontal position, then movable contact 21 contacts left side contact 22-1 and due to the difference in their positions on axially supporting support piece 20, the movable contact 21' contacts the right side contact 22-2. Further, by pivoting the knob 14 to either the right or left side, said movable contact 21 is shifted from contact 22-1 to 22-2. Depending on the pivoted direction of the knob 14, the rotation direction of a motor, for example, is reversed and, at the same time, current flows through said coil 9.

Therefore, it is possible to rotate the knob 14 to such an extent that the presser 16 is not locked by the detainer **10*b* and may rotate the motor in either the normal way or reversed way, depending on the pivoted direction of the knob 14. If the operation of the knob 14 should be stopped, then the pivoting of the knob 14 returns to its horizontal position. In this case, the motor stops rotating when the movable contacts 21 or 21'** return to their initial positions and rest thereby.

If the knob 14 is tilted through a larger angle in either the right or left direction until the presser 16 is locked by detents **10*b*, then the motor starts normal or reverse rotation. Even if the knob is stopped, then the knob 14 is held in the same position because the presser 16 is locked by the detent 10***b*. Therefore, the motor continues its normal or reverse rotation.

On the other hand, if overcurrent flows through the motor because of an incidental increase of the load on the motor, then the overcurrent flows to the coil 9 as well. Then, the second movable core 6 is actuated and presses against the first movable core 5 and the pushing up force of the retaining member 10 is thereby weakened. As a result, said presser 16 is released from retention by the detent 10*b*. As a result, the knob 14 returns to its horizontal position, the motor stops its rotation and the current stops flowing through said coil 9.

Figure 17:
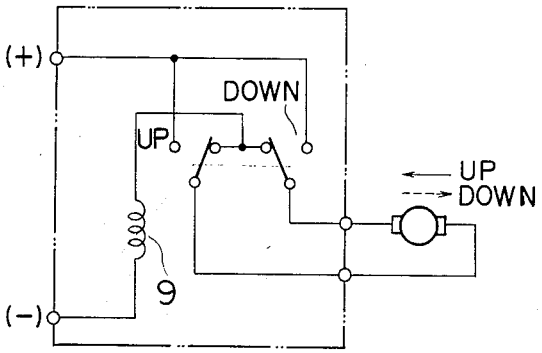
FIG. 17 is a circuit diagram when the present invention is applied to a one-touch power window switch.

Therefore, if a motor for opening or closing a car window should be used as shown in FIG. 17, then it is possible to open or close the window only when the knob is manually operated. It is also possible to open or close the window completely by tilting said knob 14 through the larger angle so that the presser 16 is locked by the detent 10*b*. The motor stops its rotation automatically upon completion of the operation. In other words, one-touch operation is thus attained. This can also be used for the sun roof, the automatic antenna, etc.

When the motor is locked, then the lock current flows. If the amount of lock current is small, then the second movable core 6 is not operated. However, even in the case, the knob 14 will not return to the horizontal position, because the bimetal within the motor is separated in order to prevent current from flowing through said coil 9.

Figure 18:
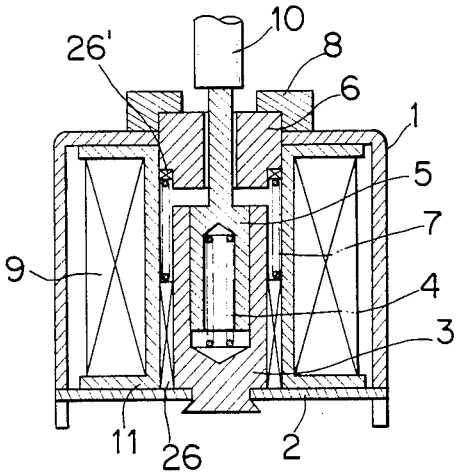
FIG. 18 is a sectional view of a further embodiment.

In FIG. 18, shading coils 26 and 26' are provided inside the bobbin of in FIG. 1. Because of the induced current of said shading coils 26 and 26', the action of said second movable core 6 due to the excitation of said coil 9 is delayed so that possible misfunction of said second movable core 6 can be prevented. Such misfunction can take place when current begins to flow through the motor as rushing current. Said shading coils 26 and 26' may be separately used instead of using both (either one will do) and the size is also optional.

Another embodiment of the invention will be described by referring to FIG. 19.

A coil 33 is wound around a bobbin 32 through which a yoke 31 is inserted. A first magnetic member in the form of an armature 35 is urged toward said yoke 31 by means of a leaf spring 34 which is fastened to one end thereof. Said armature 35 abuts a retaining member 36 and which corresponding to said retaining member 10 of the previous embodiment.

Said yoke 31 is also provided with a case 38 containing a second magnetic member in the form of a core 37. A spring 38 is stretched disposed between the cylindrical portion of said bobbin 32 and the core 37 in order to energize the latter upwardly. Said armature 35, core 37, leaf spring 34 and spring 39 are equivalent to said first movable core 5, second movable core 6, first spring 4 and second spring 7 of the previous embodiment, respectively.

Therefore, should no current flow into said coil 33, then said armature 35 is lowered downwards against the spring 34 by means of the depressing force of said retaining member 36. When the depressing force of said retaining member 36 is removed, then armature 35 is urged toward said core 37 by means of said leaf spring 34. When a prescribed current flows in said coil 33, then armature 35 is held by attraction of said core 37 which attraction is created by the magnetic circuit formed by said yoke 31, core 37 and armature 35. Even if the depressing force on said retaining member 36 is reinstated, said core 37 will not be lowered, because the biasing force of said spring 39 is stronger than the depressing force and therefore, said retaining member 36 is held in the position as shown in FIG. 19.

However, when overcurrent larger than the prescribed amount flows through said coil 33, the attractive force of said core 37 for said yoke 31 becomes stronger than the biasing force of said spring 39 and said core 37 is lowered until it reaches said yoke 31. Therefore, said armature 35 is also lowered and stops pushing up said retaining member 36.

Likewise, since said retaining member 36 conducts the same operation as the previous embodiment, it can be likewise applied to the switch section arranged in association with the previous embodiment.

Figure 20:
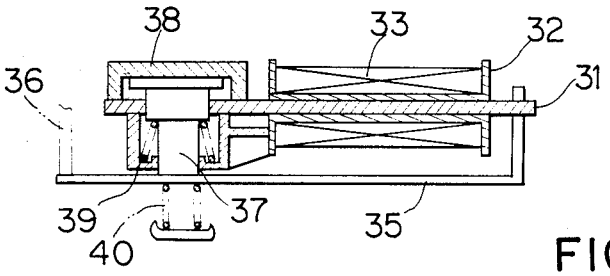
FIGS. 20 and 21 are still further embodiments.

In another embodiment shown in FIG. 20, a coil spring 40 serves as the leaf spring 34 of the preceeding embodiment and urges the armature 35 upwardly. The function thereof is not substantially different therefrom.

Figure 19:
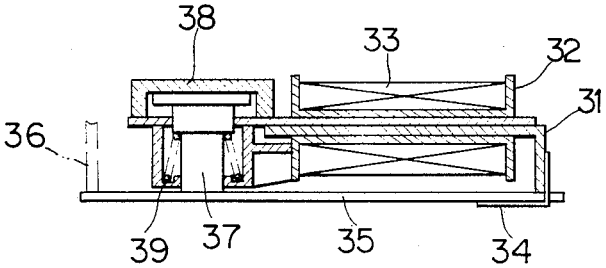
FIG. 19 is a sectional view showing a still further embodiment.
Figure 21:
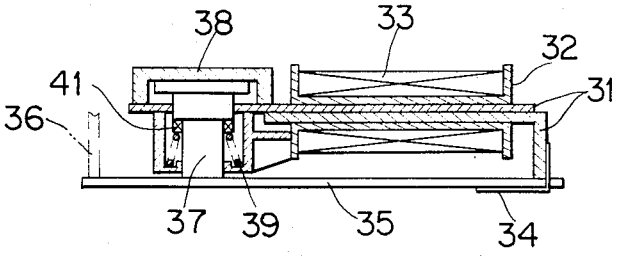

A further embodiment in FIG. 21 employs a shading coil 41 around said core 37 of the embodiment in FIG. 19 and the function of said shading coil 41 is to prevent mismanipulation due to the rushing current fed to the motor as described with regard to the embodiment in FIG. 18.

Figure 22:
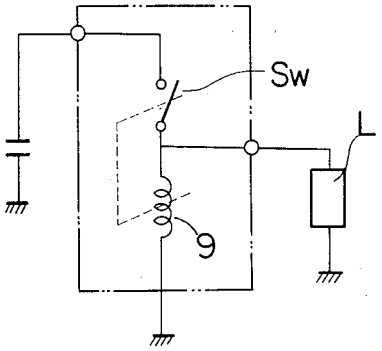
FIGS. 22 and 23 are circuit diagrams when the electromagnet assembly of said embodiment is employed in a self-holding circuit having overvoltage protection means as well as overcurrent protection means.

Next, when the invention is used as an overvoltage protection apparatus, a load L is connected in parallel with said coil 9 of the first embodiment as but shown in FIG. 22. A switch Sw is connected to said retaining member 10 of the first embodiment. Upon opening of the switch Sw, said coil 9 is excited so that said first movable core 5 is attracted by said second movable core 6 to hold the "ON" position.

When the voltage of the electric power source increases, then the current passing through said coil 9 is also increased and thereby provides the overcurrent. Then, said second movable core 6 is activated to work on said retaining member 10 in order to shift the state of the switch to that of "OFF". Therefore, it functions as an overvoltage protection apparatus.

Figure 23:
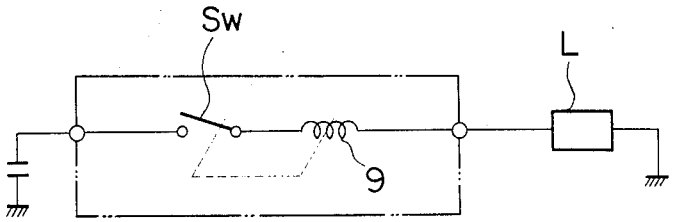

Furthermore, when the present invention is used as an overcurrent protection apparatus, said coil 9 and load L are interconnected in series, as shown in FIG. 23. Said coil 9 is excited by using a switch 51 of the type shown in FIG. 22 in order to hold the switch Sw in the state of "ON". Likewise, the switching of said switch Sw to the "OFF" position is made possible due to the overcurrent. Therefore, it serves as an overcurrent protection apparatus as well.

Figure 24:
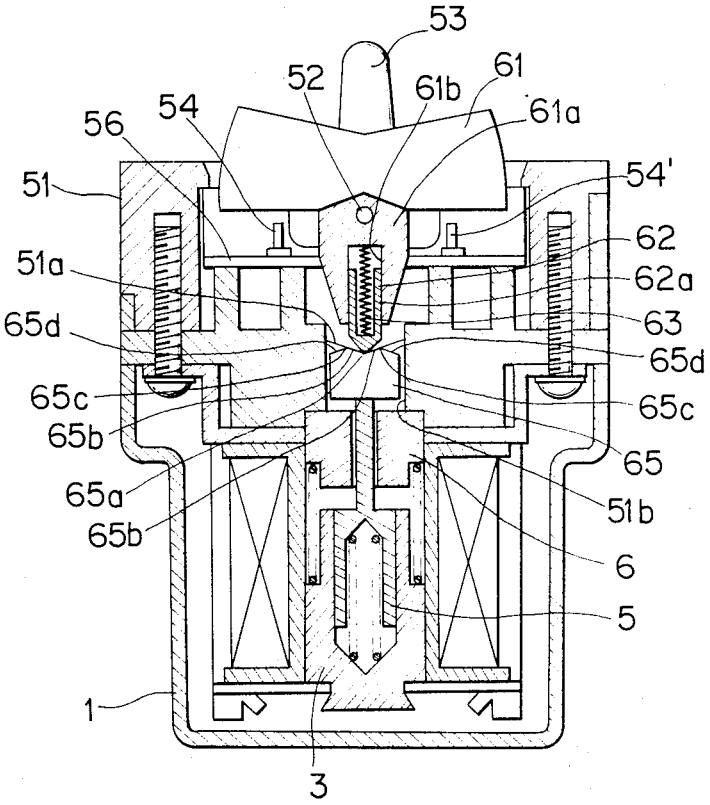
FIGS. 24 and 25 are a sectional view and an exploded perspective view respectively of a power window switch to which the present invention is applied.
Figure 25:
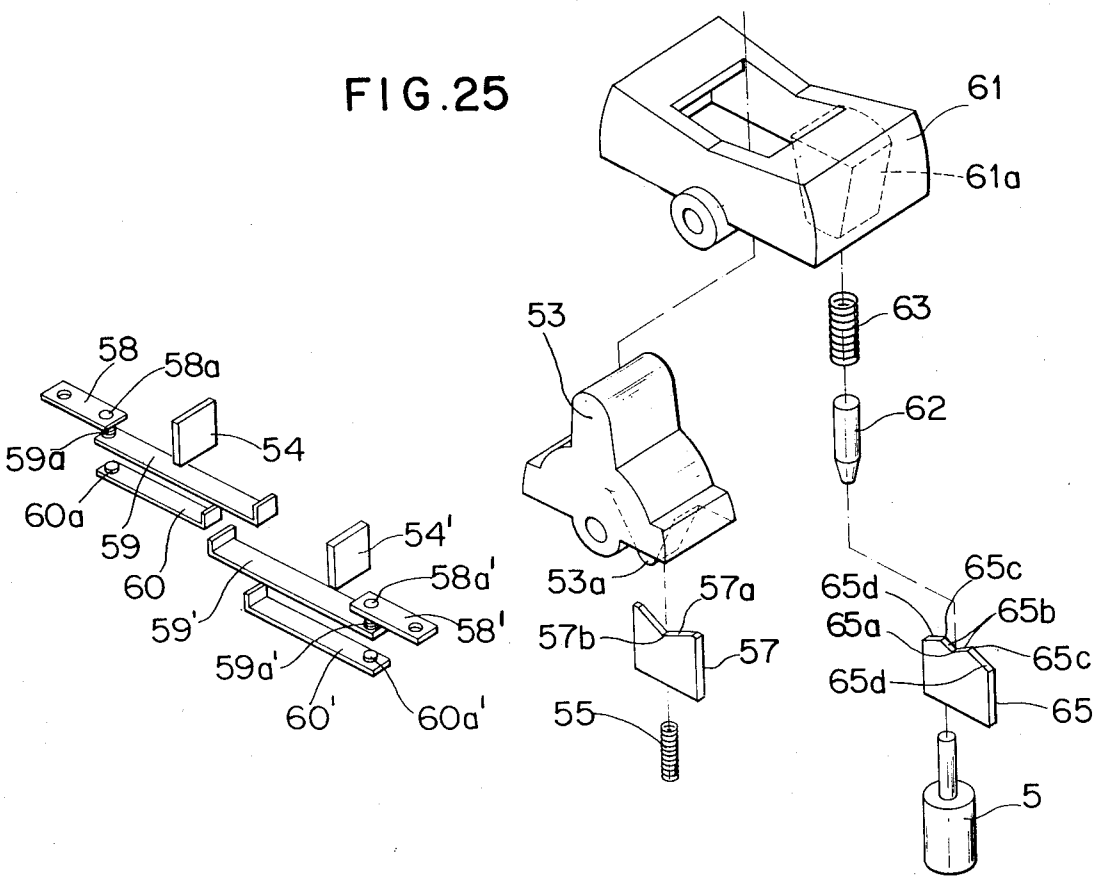

FIGS. 24 and 25 show the present invention applied to a switch for a car power window. Numeral 51 denotes a base and 52 is a pin rotatably supporting a manual knob 53 with respect to said base 51. A raised portion 53*a* is integrally formed at the lower portion of said knob 53, and faces serrated plate 57 which has a declined portion 57*a* and a sink portion 57*b*. Said serrated plate 57 is vertically movable through a slit (not shown) defined in said base 51. A spring 55 is provided in a through hole communicating with said slit in order to urge said serrated plate 57 upwardly at all times. Numerals 54 and 54' are cards vertically movably held by a guide 56 which is securely fixed to base 51 and abutted at the ends with leaf springs 59 and 59' having contacts 59*a* and 59*a'*. Contacts 59*a* and 59*a'* are in contact with normaly closed contacts 58*a* and 58*a'* of plate members 58 and 58', or contacts 60*a* and 60*a*' of plate member 60 and 60'.

Numeral 61 denotes an automatic knob rotatably supported by a pin 52. A raised portion 61*a* is provided underneath thereof. A hole 61*b* is defined in the raised portion 61*a* and a presser 62 urged downwardly by a spring 63 as best shown in FIG. 24, is vertically movably held therein. The presser 62 is engaged with a raised portion 51*a* of base 51 and with detent plate 65 which includes declined portion 65*b*, sink portion 65*a* and raised portion 65*c*. Said detent plate 65 is slidably mounted in a slit 51*b* formed at the center of said raised portion 51*a* and abuts said movable core 5 of the holding magnet. Since the details of structure of the said holding magnet have already been described above, description thereon is hereby eliminated.

The function thereof will be described next. When the manual knob 53 is rotated counterclockwise in FIG. 24 against the biasing force of said spring 55, then card 54 is pressed downwardly by the undersurface of said knob 53. Then, said contact 59*a* of said leaf spring 59 which is kept in constant contact with said contact 58*a*, now comes into contact with said contact 60*a*, because said leaf spring 59 is pressed downwards by said card 54. Then, the current passes through a motor (not shown) which in turn rotates normally or reversedly to open the car window. Upon stopping of the operation, said raised portion 53*a* of said knob 53 is rotated clockwise in FIG. 25 along said declined portion 57*a* by means of said spring 55 and is stopped at said sink portion 57*b*. At this moment, said leaf spring 59 is restored due to the restoring force and therefore, said contact 59*a* comes into contact with said contact 58*a* again in order to break the current flowing to the motor, thereby stopping the motor. As a result, the car window is stopped at that position. On the otherhand, when said knob 53 is rotated clockwise, the window is closed by means of the reversed operation with respect to the above operation and when the depressing is stopped, the window stops moving immediately.

Next, when said automatic knob 61 is rotated counterclockwise in FIG. 24 against the biasing force of said spring 63, said presser 62 is slidingly moved along said raised portion 51*a*. Then, said card 54 is pressed downwards by means of the undersurface of said knob 61 and the motor is rotated normally, in the same way as mentioned above. At this moment, current starts flowing through said coil 9 and said first movable core 5 is attracted by said second movable core 6. Said detent plate 65 is pressed upwards and said presser 62 is clamped between the right declined portion of said serrated plate in FIG. 25 and the right declined portion of said detent plate 65, and held therebetween. As a result, even if the hand is removed from said knob 61, the motor is kept revolving. When the window is opened completely, the overcurrent flows through the motor. As a result, said movable core 6 is attracted by said stationary core 3, and said movable core 5 is lowered. As a result, said presser 62 becomes free of retention of said detent plate 65 and returns to its neutral position. At the same time, current stops passing through the motor as well. When said automatic knob 61 is tilted clockwise, the window is closed by the reversed operation of the above. Upon closing, said automatic knob 61 returns to its neutral position and current stops flowing to the motor.

As mentioned above, according to the present invention, two movable cores are provided in a coil and perform their own functions depending on the strength of the magnetic force of the coil. In case the current is less than a prescribed value, the attractive force between the first movable core and the second movable core is weakened so that the first movable core may not hold an external force. In case a prescribed current flows, the second spring can hold the external force, since the attractive force between the first and second movable cores is stronger. In case a strong current flows, the magnetic flux between the second movable core and the stationary movable core is increased due to magnetic saturation of the first movable core, so that the second movable core is attracted against the biasing force of the second spring, in the reverse direction with respect to the attracted direction of the first movable core, thereby removing the holding of the external force by the first movable core. By this, for example, "ON" and "OFF" operation of a switch can be conducted in three steps, i.e., weak, medium and strong. Therefore, when compared with the prior art where 2 plunger solenoids are used or 1 solenoid and 1 electronic circuit are used, reduction of bulk, decrease in installation costs and simplicity of circuit structure are attained.

Furthermore, according to the present invention, two movable cores work differently depending on the strength of magnetic excitation. It is possible therefore to drive a motor which is maintained in the "ON" state by the switch and to shift the state from "ON" to "OFF" after completion of the required operation by the motor because of the overcurrent due to motor lock this can be applied, for example, to the car power window, the sun roof, the automatic antenna and the like, with the result that completion of the operation by "one-touch" manipulation and shifting of the switch to the "OFF" position as soon as the operation is completed is possible. As seen in the foregoing, the present invention has many advantages including a simplified circuit.

What is claimed is:

1. An electromagnetic assembly operable at two energization levels, comprising:

(a) affixed position core means;

(b) coil means disposed about said core means and including means connecting said coil means to a source of electricity for energizing said coil means and thereby generating a magnetic circuit;

(c) a first magnetically movable member associated with said core means so as to be positioned in said circuit when said coil is energized and said first member movable between a first and a second position;

(d) a second magnetically movable member associated with said first member so as to be positioned in said circuit when said coil is energized and said second member movable between a first and a second position;

(e) first resilient means bearing against said first member for urging said first member from said first to said second position;

(f) second resilient means bearing against said second member for urging said second member from said first to said second position and said second resilient means exerts a force greater than the force exerted by said first resilient means;

(g) said second member spaced from said first member when said second member is in said second position and said first member is in said first position; and, (h) retaining means operably associated with said first member for maintaining said first member in said first position when said coil means is not energized whereby energization of said coil means to a preselected first level causes said first member to move from said first to said second position and to thereby engage said second member and subsequent energization of said coil means to a preselected second level greater than the first level causes said engaged first and second members to move from said second to said first positions.

2. The assembly as defined in claim 1, wherein:
(a) said coil means and said first and second members are coaxial.

3. The assembly as defined in claim 2, wherein:
(a) a housing surrounds said coil means and said core means is secured to said housing; and,
(b) stopper means are mounted to said housing and are engageable with said second member for preventing said second member from escaping from said housing.

4. The assembly as defined in claim 3, wherein:
(a) an aperture is in said housing and said stopper means disposed adjacent said aperture; and,
(b) said second member axially movably disposed in said aperture.

5. The assembly as defined in claim 2, wherein:
(a) a bore is disposed in said core means coaxial with said first and second members; and,
(b) said first member positioned in said bore.

6. The assembly as defined in claim 5, wherein:
(a) said first resilient means includes a spring positioned in said bore.

7. The assembly as defined in claim 5, wherein:
(a) each of said core means and said second member has an annular recess and said recesses are aligned; and,
(b) said second resilient means annularly mounted about said second member and said core means and disposed in said recesses.

8. The assembly as defined in claim 5, wherein:
(a) an aperture through said second member is coaxial with said bore; and,
(b) a portion of said first member extends through said second member aperture and is connected to said retaining means.

9. The assembly as defined in claim 1, wherein:
(a) a shading coil connected to one of said core means and said second member for delaying energization of said coil means to the second level.

10. The assembly as defined in claim 1, wherein:
(a) said core means includes a laterally extending yoke;
(b) said first member disposed in parallel relation with said yoke; and,
(c) said second member disposed transverse to said first member.

11. The assembly as defined in claim 10, wherein:
(a) said first resilient means includes a leaf spring.

12. The assembly as defined in claim 10, wherein:
(a) said first and second resilient means are coaxial.

13. The assembly as defined in claim 1, wherein:
(a) said first and second resilient means are coaxial.

14. The assembly as defined in claim 3, wherein:
(a) a selector button is pivotally secured to said housing and,
(b) a movable presser connected to said button bears against said retaining means and thereby exerts a force on said retaining means sufficient to cause said first member to be maintained in said first position when said coil is not energized.

15. The assembly as defined in claim 14, wherein:
(a) means associated with said presser for maintaining said button in a preselected pivoted position while said first member is in said second position.

16. An electromagnetic assembly, comprising:
(a) a coil adapted to be electrically energized for generating a magnetic circuit and said magnetic circuit associated with the energization of said coil;
(b) switch means operably connected to said coil, a source of electrcity and to a load for simultaneously energizing said coil and causing an operation to be performed on said load;
(c) a fixedly positioned core associated with said coil so as to be positioned in said magnetic circuit when said coil is energized;
(d) first and second magnetically movable members cooperatively associated with said core and adapted for being moved in response to energization of said coil;
(e) first resilient means bearing against said first member for urging said first member towards said second member;
(f) second resilient means bearing against said second member for urging said second member away from said first member and said second resilient means exerting a force exceeding the force exerted by said first resilient means for thereby spacing said first member from said second member; and,
(g) retainer means cooperatively associated with said switch means and operatively engaged with said first member for maintaining said first and second members spaced apart;
(h) whereby, positioning of said switch means in a first operative position causes the load to be operated on and said coil to be energized to a first preselected level generating a magnetic circuit causing said first member to be attracted to said second member with sufficient force to overcome said retaining means so that said first member engages said second member and thereby locks said switch means in said first position and, upon completion of the operation on said load, said coil is energized to a second level higher than said first level and generates a magnetic circuit causing said second member to be attracted to said core with sufficient force to overcome said second resilient means so that said second member engages said core and thereby shifts said switch means to a second position associated with completion of the operation and cessation of energization of said coil.

17. The assembly as defined in claim 16, wherein:
(a) said coil means and said first and second members positioned in a housing; and,
(b) said switch means pivotally connected to said housing and having a plurality of preselected positions and each of said positions associated with an operation to be performed on said load.

18. The assembly as defined in claim 17, wherein:
(a) said core and said first and said second members are coaxial; and,
(b) switch means has a movable presser extending therefrom engageable with said retaining means and adapted to exert a force of sufficient strength on said retaining means to cause said first member to be maintained in a first position spaced from said second member when said switch means is in a preselected position.

19. The assembly as defined in claim 18, wherein:

(a) detent means are associated with said housing and are engageable by said presser and are adapted for maintaining said presser in a preselected position.

20. The assembly as defined in claim 19, wherein;

(a) third resilient means associated with said switch means bearing on said presser for longitudinally displacing said presser during pivoting of said switch means so that said presser engages and is retained by said detent means.

* * * * *